US009539849B2

(12) United States Patent
Hsu

(10) Patent No.: US 9,539,849 B2
(45) Date of Patent: Jan. 10, 2017

(54) HYDRAULIC TRANSFER FILM, PATTERN FILM, AND METHOD OF FORMING A HYDRAULIC TRANSFER FILM

(71) Applicant: Mao-Feng Hsu, Taipei (TW)

(72) Inventor: Mao-Feng Hsu, Taipei (TW)

(73) Assignee: Young Sun Chemtrade Co., Ltd., Taipei (TW)

( * ) Notice: Subject to any disclaimer, the term of this patent is extended or adjusted under 35 U.S.C. 154(b) by 439 days.

(21) Appl. No.: 14/220,231

(22) Filed: Mar. 20, 2014

(65) Prior Publication Data

US 2015/0037538 A1 Feb. 5, 2015

(30) Foreign Application Priority Data

Jul. 30, 2013 (TW) ..... 102127263 A

(51) Int. Cl.
*B44F 9/12* (2006.01)
*B05D 3/06* (2006.01)
*B44C 1/175* (2006.01)

(52) U.S. Cl.
CPC ..... *B44C 1/175* (2013.01); *Y10T 428/24364* (2015.01); *Y10T 428/24851* (2015.01)

(58) Field of Classification Search
CPC ..... B44C 1/175; Y10T 428/24851; Y10T 428/24364
See application file for complete search history.

(56) References Cited

U.S. PATENT DOCUMENTS 6,040,040 A * 3/2000 Rainbow ..... B41M 5/38207 427/146
2006/0073342 A1* 4/2006 Ariga ..... B44C 1/175 428/413
2011/0209640 A1* 9/2011 Chiu ..... B44C 1/1758 101/483
2015/0277376 A1* 10/2015 Wu-Lu ..... G03H 1/0402 430/2
2016/0089873 A1* 3/2016 Wu-Lu ..... B44C 1/1756 101/170

FOREIGN PATENT DOCUMENTS

| | | | |
|---|---|---|---|
| CN | 2013/53913 | Y | 12/2009 |
| CN | 2015/66384 | U | 9/2010 |
| TW | I315261 | B | 12/1993 |
| TW | 2011/29480 | A | 9/2011 |
| TW | 2012/02060 | A1 | 1/2012 |
| TW | I374811 | B1 | 10/2012 |

* cited by examiner

*Primary Examiner* — Patricia L Nordmeyer
(74) *Attorney, Agent, or Firm* — Cesari and McKenna, LLP

(57) ABSTRACT

A hydraulic transfer film includes: a water-soluble substrate, a pattern-forming layer formed on the water-soluble substrate and having a water-soluble region and an oil-soluble region, an oil-soluble pattern layer formed on the pattern-forming layer, an oil-soluble base layer formed on the oil-soluble pattern layer, and an activating layer including a curable activating agent that permeates into the oil-soluble region, the oil-soluble pattern layer, and the oil-soluble base layer such that the oil-soluble region, the oil-soluble pattern layer, and the oil-soluble base layer are partly soluble in the curable activating agent. A method of forming the hydraulic transfer film and a pattern film are also disclosed.

17 Claims, 4 Drawing Sheets

HYDRAULIC TRANSFER FILM, PATTERN FILM, AND METHOD OF FORMING A HYDRAULIC TRANSFER FILM

CROSS-REFERENCE TO RELATED APPLICATION

This application claims priority of Taiwanese application no. 102127263, filed on Jul. 30, 2013.

BACKGROUND OF THE INVENTION

1. Field of the Invention

This invention relates to a hydraulic transfer film, a pattern film, and a method of forming a hydraulic transfer film.

2. Description of the Related Art

A conventional hydraulic transfer method includes: forming a pattern layer on a water-soluble substrate, spray coating an activating agent on the pattern layer to activate the pattern layer, pressing the activated pattern layer on the water-soluble substrate against an article in water so as to transfer the pattern layer onto the article, curing the pattern layer and the activating agent on the article by ultraviolet light or heat, and removing the water-soluble substrate from the cured pattern layer so as to obtain the article with the desired pattern.

With an increase in requirements for higher quality of the hydraulic transfer pattern, a hydraulic transfer film that can provide a superior three-dimensional pattern and desired touch feeling is required.

U.S. Patent Application Publication No. 20110209640A1 discloses a method of forming three-dimensional patterns on an article surface. Referring to FIG. 1, in this method, a hydraulic transfer film 1 is used, which includes a water-soluble substrate 10, a pattern layer 12 formed on the water-soluble substrate 10, a base layer 13 formed on the pattern layer 12 and the water-soluble substrate 10, and an activating layer 14 formed on the base layer 13 and including a curable activating agent. The activating agent can dissolve the base layer 13 but cannot dissolve the pattern layer 12.

Due to the structural design of the hydraulic transfer film 1, the conventional method may not provide good three-dimensional transferring effect when the pattern layer 12 has a relatively large area.

SUMMARY OF THE INVENTION

Therefore, the object of the present invention is to provide a hydraulic transfer film, a pattern film, and a method of forming a hydraulic transfer film that can overcome at least one of the aforesaid drawbacks of the prior art.

According to one aspect of the present invention, there is provided a hydraulic transfer film that includes: a water-soluble substrate, a pattern-forming layer formed on the water-soluble substrate, and having at least one water-soluble region and at least one oil-soluble region, an oil-soluble pattern layer formed on the pattern-forming layer, an oil-soluble base layer formed on the oil-soluble pattern layer, and an activating layer formed on the oil-soluble base layer and including a curable activating agent that permeates into the oil-soluble region, the oil-soluble pattern layer, and the oil-soluble base layer such that the oil-soluble region, the oil-soluble pattern layer, and the oil-soluble base layer are partly soluble in the curable activating agent during a hydraulic transfer process.

According to another aspect of the present invention, there is provided a pattern film that includes: an activating layer including a cured activating agent, an oil-soluble base layer formed on the activating layer, an oil-soluble first pattern layer, and an oil-soluble second pattern layer that is formed between the oil-soluble first pattern layer and the oil-soluble base layer, the oil-soluble first pattern layer protruding from and partially covering the oil-soluble second pattern layer so as to define a three-dimensional pattern. The oil-soluble base layer, the oil-soluble second pattern layer, and the oil-soluble first pattern layer are admixed with the cured activating agent permeating from the activating layer.

According to yet another aspect of the present invention, there is provided a method of forming a hydraulic transfer film that includes the steps of:

(a) forming a pattern-forming layer on a water-soluble substrate, the pattern-forming layer having at least one water-soluble region and at least one oil-soluble region;

(b) forming an oil-soluble pattern layer on the pattern-forming layer;

(c) forming an oil-soluble base layer on the oil-soluble pattern layer; and (d) forming an activating layer on the oil-soluble base layer, the activating layer including a curable activating agent that permeates into the oil-soluble base layer, the oil-soluble pattern layer, and the oil-soluble region, such that the oil-soluble base layer, the oil-soluble pattern layer, and the oil-soluble region are partly soluble in the curable activating agent during a hydraulic transfer process.

BRIEF DESCRIPTION OF THE DRAWINGS

Other features and advantages of the present invention will become apparent in the following detailed description of the preferred embodiments of this invention, with reference to the accompanying drawings, in which.

DETAILED DESCRIPTION OF THE PREFERRED EMBODIMENTS

Figure 1:
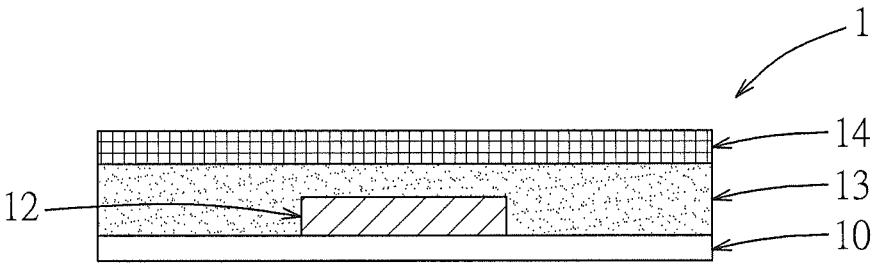
FIG. 1 PRIOR ART
FIG. 1 is a schematic cross-sectional view of a conventional hydraulic transfer film.

Before the present invention is described in greater detail, it should be noted that like elements are denoted by the same reference numerals throughout the following description.

Figure 2:
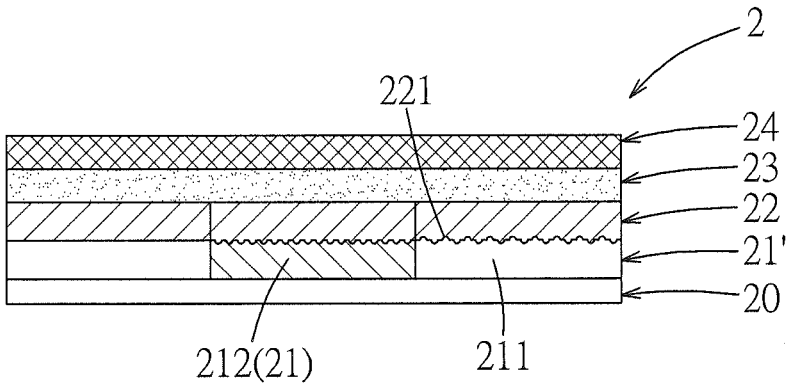
FIG. 2 is a schematic cross-sectional view of the first preferred embodiment of a hydraulic transfer film according to this invention.

Referring to FIG. 2, the first preferred embodiment of a hydraulic transfer film 2 according to the present invention is shown to include a water-soluble substrate 20, a pattern-forming layer 21', an oil-soluble pattern layer 22, an oil-soluble base layer 23, and an activating layer 24. The pattern-forming layer 21' is formed on the water-soluble substrate 20 and has at least one water-soluble region 211 and at least one oil-soluble region 212. The oil-soluble pattern layer 22 is formed on the pattern-forming layer 21'. The oil-soluble base layer 23 is formed on the oil-soluble pattern layer 22 and is used to support the pattern-forming layer 21' and the oil-soluble pattern layer 22 and/or to provide decorating effect. The activating layer 24 is formed on the oil-soluble base layer 23 and includes a curable activating agent that permeates into the oil-soluble region 212, the oil-soluble pattern layer 22, and the oil-soluble base layer 23 such that the oil-soluble region 212, the oil-soluble pattern layer 22, and the oil-soluble base layer 23 are partly soluble in the curable activating agent during a hydraulic transfer process.

The pattern-forming layer 21', the oil-soluble pattern layer 22, and the oil-soluble base layer 23 are made of oil-soluble or water-soluble ink materials.

Preferably, the oil-soluble ink material used in the present invention is an oil paint including ultraviolet curable pigments, color paint, etc., and may be made from a polyurethane-acrylic composition. The oil-soluble ink may further contain a plurality of micro powders, e.g., fuzz powders, wax, or flat powders. Examples of the oil-soluble ink includes, but not limited to SHC-UA01, SPI-UC01, SPI-UF01, or SPI-L-US01 available from DAIGIN CHEMICAL CO., LTD.

The water-soluble ink used in the present invention is a water paint including pigments, color paint, etc. The water-soluble ink may further include a plurality of micro powders, e.g., fuzz powders, wax, or flat powders. Examples of the water-soluble ink includes, but not limited to, WHC-A01, WHPI-C01, or WHPI-F01.

It is noted that the micro powder included in the ink material would provide leather-like appearance for the hydraulic transfer film 2.

Preferably, the pattern-forming layer 21', the oil-soluble pattern layer 22, and the oil-soluble base layer 23 may be formed using, e.g., a printing method, a spraying method, or a roller coating method.

The curable activating agent is used to partly dissolve the oil-soluble region 212, the oil-soluble pattern layer 22, and the oil-soluble base layer 23, so as to impart flexibility to the oil-soluble region 212, the oil-soluble pattern layer 22, and the oil-soluble base layer 23, and to facilitate peeling of the same from the water-soluble substrate 20, thereby improving conformability and adhesion of the same to an article to be transferred. Preferably, the curable activating agent is curable by heating or by radiation. More preferably, the curable activating agent is curable by ultraviolet light. The curable activating agent is an ultraviolet curable paint including ultraviolet curable pigments, color paint, flat paint, etc., and may be made from a polyurethane-acrylic composition. Example of the curable activating agent includes, but not limited to UVAU-A01, UVAU-F01, or UVAU-C01 available from DAIGIN CHEMICAL CO., LTD. The amount of the curable activating agent is preferably from 15 to 60 $g/m^2$.

Figure 3:
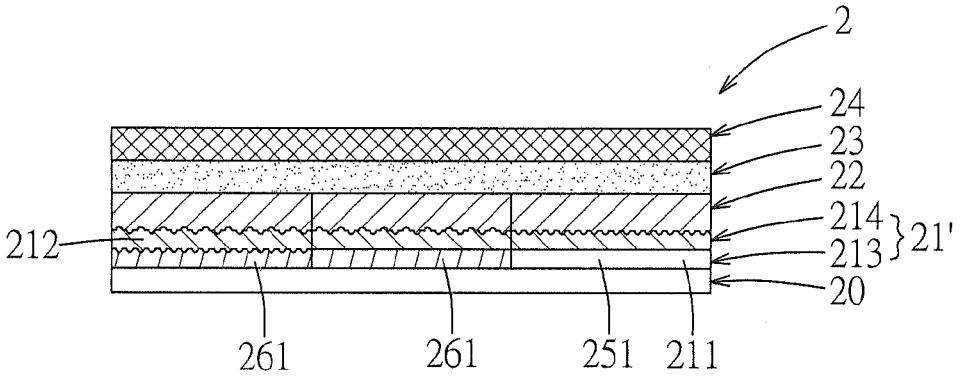
FIG. 3 is a schematic cross-sectional view of the second preferred embodiment of a hydraulic transfer film according to this invention.

FIG. 3 shows the second preferred embodiment of a hydraulic transfer film 2 according to the present invention. The difference between the first and second preferred embodiments is that, in the second preferred embodiment, the pattern-forming layer 21' includes a first sub-layer 213 that is formed on the water-soluble substrate 20, and a second sub-layer 214 that is formed between the first sub-layer 213 and the oil-soluble pattern layer 22 and that is oil-soluble. The first sub-layer 213 includes at least one water-soluble area 251, and at least one oil-soluble area 261. The water-soluble area 251 defines the water-soluble region 211, and the oil-soluble area 261 cooperates with the second sub-layer 214 to define the oil-soluble region 212.

Figure 4:
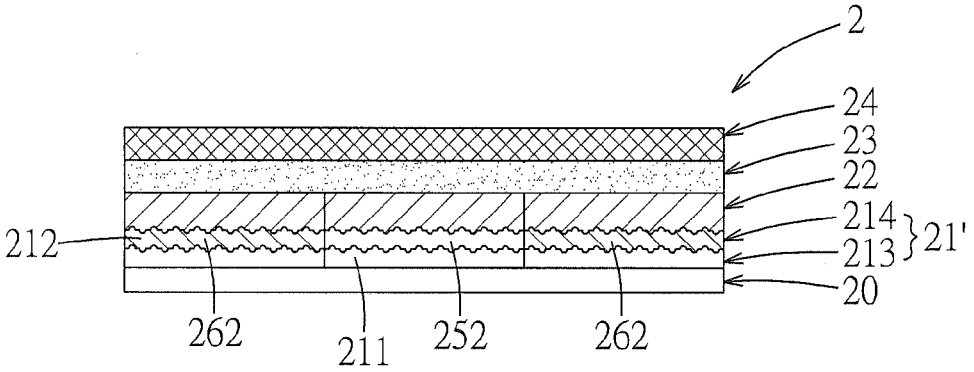
FIG. 4 is a schematic cross-sectional view of the third preferred embodiment of a hydraulic transfer film according to this invention.

FIG. 4 shows the third preferred embodiment of a hydraulic transfer film 2 according to the present invention. The difference between the first and third preferred embodiments is that, in the third preferred embodiment, the pattern-forming layer 21' includes a first sub-layer 213 that is water-soluble and that is formed on the water-soluble substrate 20, and a second sub-layer 214 formed between the first sub-layer 213 and the oil-soluble pattern layer 22. The second sub-layer 214 includes at least one water-soluble area 252 and at least one oil-soluble area 262. The second water-soluble area 252 cooperates with the first sub-layer 213 to define the water-soluble region 211, and the oil-soluble area 262 defines the oil-soluble region 212.

Preferably, in the preferred embodiments, the hydraulic transfer film 2 further include a decorative layer disposed between the oil-soluble pattern layer 22 and the oil-soluble base layer 23. The decorative layer is made of a decorative paint and the curable activating agent can permeate into the decorative layer during the hydraulic transfer process.

Figure 5:
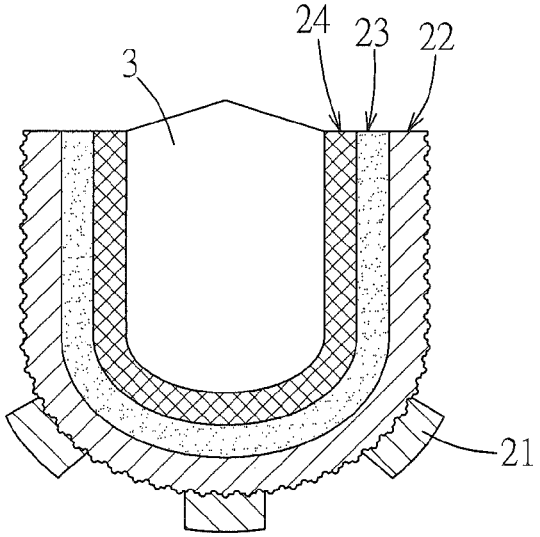
FIG. 5 is a schematic cross-sectional view of the preferred embodiment of a pattern film according to this invention which is obtained from the first preferred embodiment.

When the hydraulic transfer film 2 of the first preferred embodiment is transferred onto an article 3 using a hydraulic transfer process, a pattern film is thus formed on the article 3. Referring to FIG. 5, the pattern film is shown to include an activating layer 24 attaching to the article 3 and including a cured activating agent, an oil-soluble base layer 23 formed on the activating layer 24, an oil-soluble first pattern layer 21, and an oil-soluble second pattern layer 22 that is formed between the oil-soluble base layer 23 and the oil-soluble first pattern layer 21, the oil-soluble first pattern layer 21 protruding from and partially covering the oil-soluble second pattern layer 22 so as to define a three-dimensional pattern. The oil-soluble base layer 23, the oil-soluble second pattern layer 22, and the oil-soluble first pattern layer 21 are admixed with the cured activating agent permeating from the activating layer 24.

Figure 6A:
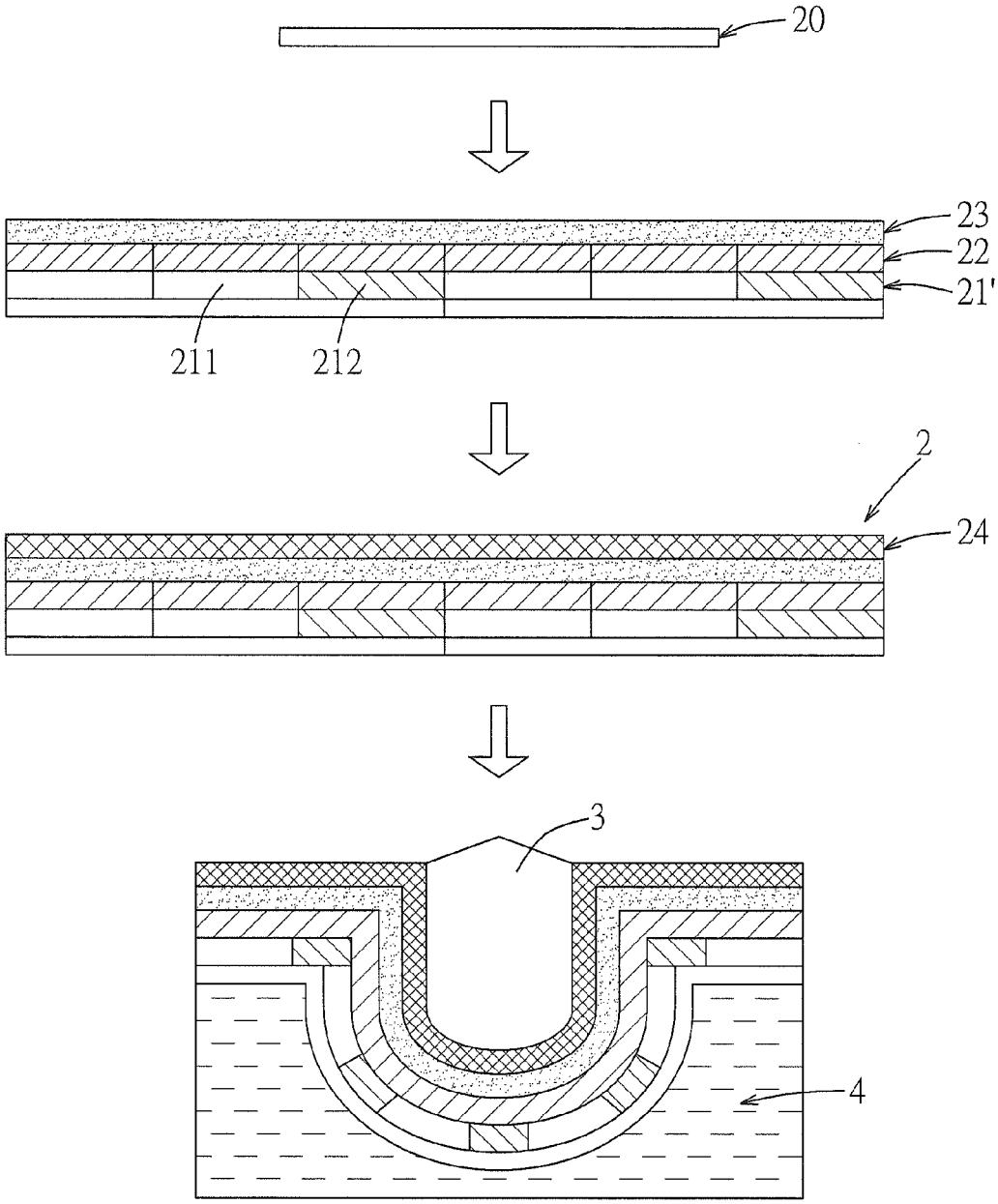
FIGS. 6A and 6B are schematic cross-sectional views illustrating a method of forming the hydraulic transfer film of the first preferred embodiment and a method of forming the pattern film on an article using the hydraulic transfer film of the first preferred embodiment through a hydraulic transfer process.
Figure 6B:
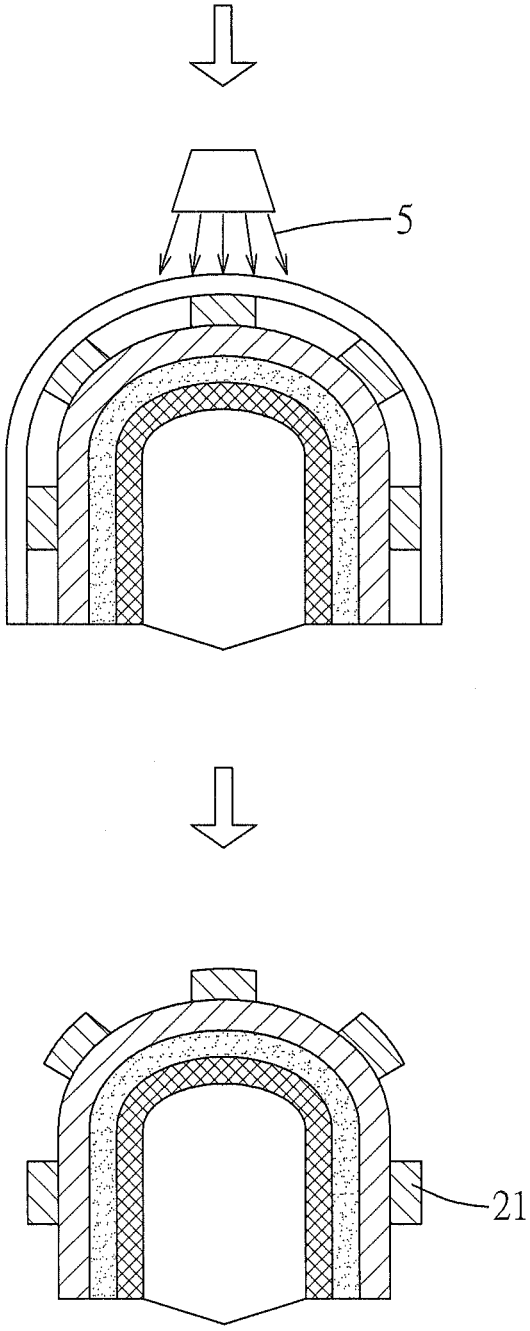

FIGS. 6A and 6B show consecutive steps illustrating a method of forming the hydraulic transfer film 2 of the first preferred embodiment and a method of hydraulically transferring the hydraulic transfer film 2 onto the article 3. As shown in FIG. 6A, the method of forming the hydraulic transfer film 2 of the first preferred embodiment includes the following steps of:

(a) forming a pattern-forming layer 21' on a water-soluble substrate 20, the pattern-forming layer 21' having at least one water-soluble region 211 and at least one oil-soluble region 212;

(b) forming an oil-soluble pattern layer 22 on the pattern-forming layer 21';

(c) forming an oil-soluble base layer 23 on the oil-soluble pattern layer 22; and (d) forming an activating layer 24 on the oil-soluble base layer 23, the activating layer 24 including a curable activating agent that permeates into the oil-soluble base layer 23, the oil-soluble pattern layer 22, and the oil-soluble region 212, such that the oil-soluble base layer 23, the oil-soluble pattern layer 22, and the oil-soluble region 212 are partly soluble in the curable activating agent during a hydraulic transfer process.

As shown in FIGS. 6A and 6B, the hydraulic transfer film 2 thus formed is further subjected to the hydraulic transfer process. The steps of the hydraulic transfer process include:

causing the hydraulic transfer film 2 to float on a surface of a body of water 4;

contacting the article 3 with the activating layer 24 of the hydraulic transfer film 2;

pressing and dipping the article 3 along with the hydraulic transfer film 2 into the water 4 to firmly attach the hydraulic transfer film 2 to the article 3 by means of hydraulic pressure;

irradiating the article 3 and the hydraulic transfer film 2 with ultraviolet light 5 to cure the curable activating agent; and removing the water-soluble substrate 20 and the water-soluble region 211 of the pattern-forming layer 21' by water so that the oil-soluble region 212 of the pattern-forming layer 21' defines the oil-soluble first pattern layer 21, and the pattern film is thus formed on the article 3.

EXAMPLE

Example 1 (E1)

A hydraulic transfer film was prepared to have the structure of the first preferred embodiment, in which the material for the water-soluble substrate 20 was a polyvinyl alcohol (PVA) film. The pattern-forming layer 21' and the oil-soluble pattern layer 22 were sequentially formed on the water-soluble substrate 20 by a printing method. The ink materials used to form the water-soluble region 211 of the pattern-forming layer 21' were WHC-A01 and WHPI-F01, which were separately formed on the water-soluble substrate 20. WHPI-F01 is a water soluble ink that includes a plurality of micro powders. The ink material for the oil-soluble region 212 of the pattern-forming layer 21' was SHC-UA01. The ink materials for the oil-soluble pattern layer 22 were SHC-UA01 and SPI-UF01. SPI-UF01 is an oil soluble ink that includes a plurality of micro powders. SHC-UA01 of the oil-soluble pattern layer 22 was formed on the WHC-A01 of the pattern-forming layer 21'. SPI-UF01 of the oil-soluble pattern layer 22 was formed on the WHPI-F01 and SHC-UA01 of the pattern-forming layer 21'. The ink material for the oil-soluble base layer 23 was SHC-UA01 which was formed on the oil-soluble pattern layer 22 using a roller coating method. The curable activating agent was UVAU-A01 and was sprayed on the oil-soluble base layer 23 to form the activating layer 24 (spraying amount: 35 g/m$^2$).

The hydraulic transfer film thus formed was then hydraulically transferred onto an article surface so as to form a pattern film on the article surface.

It is noted that since WHPI-F01 of the pattern-forming layer 21' and SPI-UF01 of the oil-soluble pattern layer 22 include a plurality of micro powders, a surface of the oil-soluble pattern layer 22 that faced the pattern-forming layer 21' was thus formed with a microstructure composed of a plurality of micro indentations 221 so as to provide a leather-like appearance on the oil-soluble pattern layer 22.

Example 2 (E2)

A hydraulic transfer film was prepared to have the structure of the second preferred embodiment, in which the ink material for the water-soluble area 251 was WHC-A01. The ink material for the oil-soluble area 261 was SHC-UA01. The ink materials for the second sub-layer 214 were SHC-UA01 and SPI-UF01. The ink material for the oil-soluble pattern layer 22 was SPI-UF01. SHC-UA01 of the second sub-layer 214 was formed on the water-soluble area 251 of the first sub-layer 213. SPI-UF01 of the second sub-layer 214 was formed on the oil-soluble area 261 of the first sub-layer 213.

The hydraulic transfer film thus formed was then hydraulically transferred onto an article surface so as to form a pattern film on the article surface.

It is noted that since SPI-UF01 of the second sub-layer 214 and the oil-soluble pattern layer 22 includes a plurality of micro powders, a microstructure composed of a plurality of micro indentations 221 was formed to provide a leather-like appearance for the hydraulic transfer film 2.

Example 3 (E3)

A hydraulic transfer film was prepared to have the structure of the third preferred embodiment, in which the ink material for the first sub-layer 213 and the water-soluble area 252 was WHPI-F01. The ink material for the oil-soluble area 262 was SPI-L-US01 which includes a plurality of a micro-size fuzz powders and flat powders. The ink materials for the oil-soluble pattern layer 22 were SPI-UF01 and SPI-L-US01. SPI-UF01 of the oil-soluble pattern layer 22 was formed on the oil-soluble area 262 of the second sub-layer 214. SPI-L-US01 of the oil-soluble pattern layer 22 was formed on the water-soluble area 252 of the second sub-layer 214.

The hydraulic transfer film thus formed was then hydraulically transferred onto an article surface so as to form a pattern film on the article surface.

It is noted that since WHPI-F01, SPI-L-US01, and SPI-UF01 mentioned above include a plurality of micro powders, a microstructure composed of a plurality of micro indentations 221 was formed to provide a leather-like appearance for the hydraulic transfer film 2.

[Test]

The pattern film formed on the article surface in each of Examples 1 to 3 was scanned using a surface profilometer (Alpha-step) (purchased from Veeco Instruments Inc., Model Dektak 150). Heights in different areas of the pattern film were measured to calculate the height difference of the pattern film. The gloss difference of the pattern film was measured using PICOGLOSS model 503 from Erichsen at an angle of 60°. The results are shown in Table 1.

TABLE 1

| | E1 | E2 | E3 |
|---|---|---|---|
| Height difference (μm) | 18 | 14 | 13 |
| Gloss difference (GU) | 64 | 88 | 15 |

Table 1 shows that E1, E2, and E3 all have a significant height difference. Moreover, the height difference in E1 is slightly greater than that in E2 and E3. E1 and E2 have a significant gloss difference, i.e., have significant bright and dark visual effect.

To sum up, with the inclusion of the water-soluble region 211 in the pattern-forming layer 21', the pattern film thus formed has a superior 3D structure. Moreover, since each of the oil-soluble region 212, the oil-soluble pattern layer 22, and the oil-soluble base layer 23 is admixed with the curable activating agent of the activating layer 24, the pattern film could be firmly adhered to the article 3.

While the present invention has been described in connection with what are considered the most practical and preferred embodiments, it is understood that this invention is not limited to the disclosed embodiments but is intended to cover various arrangements included within the spirit and scope of the broadest interpretation and equivalent arrangements.

What is claimed is:

1. A hydraulic transfer film, comprising:

a water-soluble substrate;

a pattern-forming layer formed on said water-soluble substrate, and having at least one water-soluble region and at least one oil-soluble region;

an oil-soluble pattern layer formed on said pattern-forming layer;

an oil-soluble base layer formed on said oil-soluble pattern layer; and an activating layer formed on said oil-soluble base layer and including a curable activating agent that permeates into said oil-soluble region, said oil-soluble pattern layer, and said oil-soluble base layer such that said oil-soluble region, said oil-soluble pattern layer, and said oil-soluble base layer are partly soluble in said curable activating agent during a hydraulic transfer process.

2. The hydraulic transfer film as claimed in claim 1, wherein said oil-soluble pattern layer has a surface that faces said pattern-forming layer and that is formed with a microstructure composed of a plurality of indentations.

3. The hydraulic transfer film as claimed in claim 1, wherein:

said pattern-forming layer includes a first sub-layer that is formed on said water-soluble substrate, and a second sub-layer that is formed between said first sub-layer and said oil-soluble pattern layer and that is oil-soluble, said first sub-layer having at least one water-soluble area, and at least one oil-soluble area; and said water-soluble area defines said water-soluble region, and said oil-soluble area cooperates with said second sub-layer to define said oil-soluble region.

4. The hydraulic transfer film as claimed in claim 1, wherein:

said pattern-forming layer includes a first sub-layer that is water-soluble and that is formed on said water-soluble substrate, and a second sub-layer formed between said first sub-layer and said oil-soluble pattern layer, said second sub-layer having at least one water-soluble area and at least one oil-soluble area; and said water-soluble area cooperates with said first sub-layer to define said water-soluble region, and said oil-soluble area defines said oil-soluble region.

5. The hydraulic transfer film as claimed in claim 1, wherein said curable activating agent is curable by heating or by radiation.

6. The hydraulic transfer film as claimed in claim 5, wherein said curable activating agent is curable by ultraviolet light.

7. The hydraulic transfer film as claimed in claim 1, further comprising a decorative layer disposed between said oil-soluble pattern layer and said oil-soluble base layer.

8. A pattern film comprising:

an activating layer including a cured activating agent;

an oil-soluble base layer formed on said activating layer;

an oil-soluble first pattern layer; and an oil-soluble second pattern layer that is formed between said oil-soluble first pattern layer and said oil-soluble base layer, said oil-soluble first pattern layer being protruding from and partially covering said oil-soluble second pattern layer so as to define a three-dimensional pattern;

wherein said oil-soluble base layer, said oil-soluble second pattern layer, and said oil-soluble first pattern layer are admixed with said cured activating agent permeating from said activating layer.

9. The pattern film as claimed in claim 8, wherein said oil-soluble second pattern layer has a surface that faces said oil-soluble first pattern layer and that is formed with a microstructure composed of a plurality of indentations.

10. The pattern film as claimed in claim 8, further comprising a decorative layer disposed between said oil-soluble second pattern layer and said oil-soluble base layer.

11. A method of forming a hydraulic transfer film, comprising:

(a) forming a pattern-forming layer on a water-soluble substrate, the pattern-forming layer having at least one water-soluble region and at least one oil-soluble region;

(b) forming an oil-soluble pattern layer on the pattern-forming layer;

(c) forming an oil-soluble base layer on the oil-soluble pattern layer; and (d) forming an activating layer on the oil-soluble base layer, the activating layer including a curable activating agent that permeates into the oil-soluble base layer, the oil-soluble pattern layer, and the oil-soluble region, such that the oil-soluble base layer, the oil-soluble pattern layer, and the oil-soluble region are partly soluble in the curable activating agent during a hydraulic transfer process.

12. The method as claimed in claim 11, wherein the oil-soluble pattern layer has a surface that faces the pattern-forming layer and that is formed with a microstructure composed of a plurality of indentations.

13. The method as claimed in claim 11, wherein:

the pattern-forming layer includes a first sub-layer that is formed on the water-soluble substrate, and a second sub-layer that is formed between the first sub-layer and the oil-soluble pattern layer and that is oil-soluble, the first sub-layer having at least one water-soluble area, and at least one oil-soluble area; and the water-soluble area defines the water-soluble region, and the oil-soluble area cooperates with the second sub-layer to define the oil-soluble region.

14. The method as claimed in claim 11, wherein:

the pattern-forming layer includes a first sub-layer that is water-soluble and that is formed on the water-soluble substrate, and a second sub-layer formed between the first sub-layer and the oil-soluble pattern layer, the second sub-layer having at least one water-soluble area and at least one oil-soluble area; and the water-soluble area cooperates with first sub-layer to define the water-soluble region, and the oil-soluble area defines the oil-soluble region.

15. The method as claimed in claim 11, wherein the curable activating agent is curable by heating or by radiation.

16. The method as claimed in claim 11, wherein the curable activating agent is curable by ultraviolet light.

17. The method as claimed in claim 11, further comprising a decorative layer disposed between the oil-soluble pattern layer and the oil-soluble base layer.

* * * * *